United States Patent [19]

Cole et al.

[11] Patent Number: 4,460,244

[45] Date of Patent: Jul. 17, 1984

[54] SPLIT PRISMATIC ANNUNCIATOR

[75] Inventors: Carey S. Cole, Marion, Iowa; William B. Noble, Santa Monica, Calif.

[73] Assignee: Rockwell International Corporation, El Segundo, Calif.

[21] Appl. No.: 441,821

[22] Filed: Nov. 15, 1982

[51] Int. Cl.[3] ..... G09F 11/00; G08G 5/00

[52] U.S. Cl. ..... 350/112; 40/463; 40/506; 340/945

[58] Field of Search ..... 350/112; 40/463, 506; 340/27 NA; 343/107

[56] References Cited

U.S. PATENT DOCUMENTS 3,616,555 11/1971 Campbell ..... 40/463

4,312,041 1/1982 DeJorge ..... 340/27 NA

*Primary Examiner*—Bruce Y. Arnold

*Assistant Examiner*—William Propp

*Attorney, Agent, or Firm*—Bruce C. Lutz; George A. Montanye; H. Frederick Hamann

[57] ABSTRACT

The present invention pertains to a display utilizing a plurality of display prisms in a single device each of which can be separately actuated so that there can be more messages available to a user than surfaces on the prisms due to the interaction of messages on a cooperative basis.

6 Claims, 4 Drawing Figures

SPLIT PRISMATIC ANNUNCIATOR

THE INVENTION

The present invention is related generally to annunciators and more specifically to prismatic annunciators for use in high density information display areas such as aircraft instrument panels.

The prior art is replete with various types of annunciators for displaying information. One such example is U.S. Pat. No. 3,616,555, issued to M. L. Campbell and assigned to the same assignee as the present invention. This patent illustrates an annunciator quite similar to the present invention. However, it has been ascertained that it is often desirable to (1) have more displays or presentations in the same amount of space or (2) combine signal displays or presentations to provide more messages than there are display surfaces to present those messages.

Accordingly, the present invention was originated to provide two adjacent independently operable prism surfaces which, in combination, each use three surfaces to present a total of seven messages. It is, therefore, an object of the present invention to provide improved annunciator apparatus.

Other objects and advantages of the present invention may be ascertained from a reading of the specification and appended claims in conjunction with the drawings wherein:

DETAILED DESCRIPTION

Figure 1:
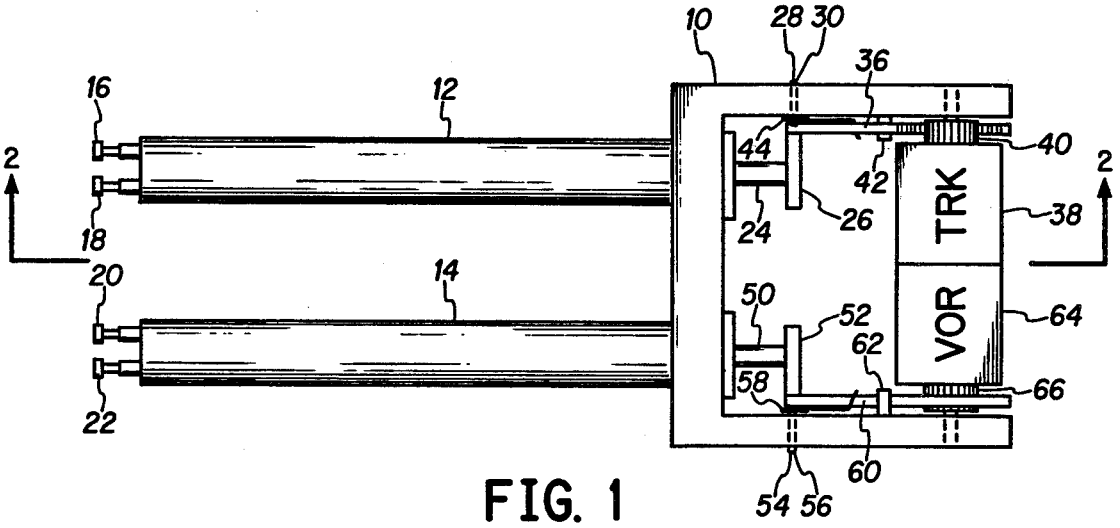
FIG. 1 is a top view of the invention including the actuating apparatus.
Figure 2:
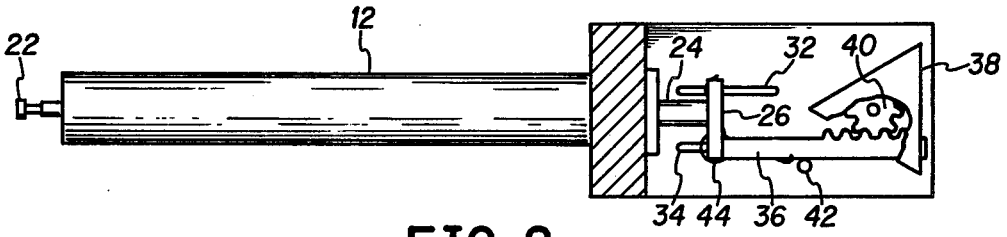
FIG. 2 is a side view of the apparatus of FIG. 1.
Figure 3:
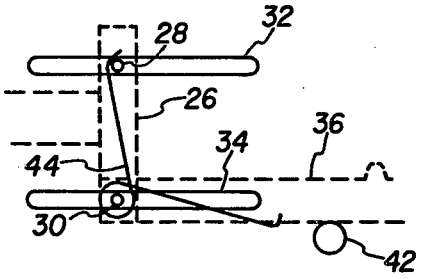
FIG. 3 is a detailed presentation of an anti-backlash feature of the invention illustrated in FIGS. 1 and 2.

In FIG. 1 a U-shaped frame member or support channel 10 is shown having two push-pull solenoids or actuators 12 and 14 mounted therein. The solenoid 12 has two electrical signal input terminals 16 and 18 while solenoid 14 has two electrical signal input terminals 20 and 22. Solenoid 12 has a movable shaft, linear actuator or armature 24 which operates a header member 26. Header member 26 has first and second pins or guides 28 and 30 as will be more easily ascertained from FIG. 3. These two guides 28 and 30 move in slots 32 and 34, respectively, for maintaining the appropriate alignment of the actuating mechanism. Pin 30 also coacts with a rack 36 to rotate prism 38 via a gear or geared member 40 at one end of prism 38. The rack 36 is restrained in movement in the upward direction by the presence of gear 40 and in the downward direction by the presence of a stop or pin 42. Finally, there is a spring or anti-backlash means 44, which is most clearly illustrated in FIG. 3, that is mounted on pin 30 and cooperates with pin 28 to provide an upward pressure on rack 36 whereby a force is continually provided against gear 40 to minimize backlash problems.

Solenoid 14 has components substantially identical to but in some cases reversed as compared with push-pull solenoid 12 and its associated drive train. More specifically, solenoid 14 has an armature 50, a header 52, pins 54 and 56, a spring 58, a rack 60, a stop pin 62 and a prism 64 including a gear member 66.

Figure 4:
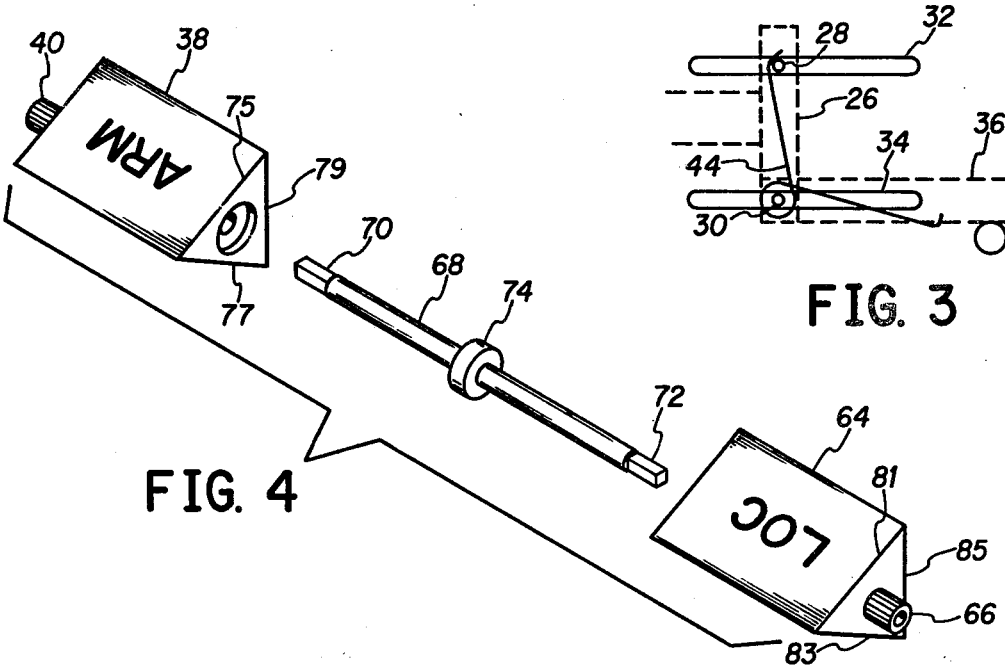
FIG. 4 is an exploded view of the indicia or annunciator prism portions of FIGS. 1 and 2.

From FIG. 4 it will be noted that the mechanism also includes a shaft or bearing member 68 upon which prisms 38 and 64 rotate. The shaft 68 has squared ends or anti-rotation portions 70 and 72 which mount in the bit portions or leg members of the support 10. The reason for having the squared ends 70 and 72 is to prevent accidental rotation of one prism upon the actuation of the other prism.

Finally, the prism 38 has three surfaces 75, 77 and 79, while the prism 64 has three surfaces 81, 83 and 85. As illustrated, surface 81 contains the message LOC or localizer while surface 75 has the message ARM to indicate that the localizer has been selected by internal circuitry but has not yet captured a localizer signal. The surface 83 of prism 64 may have the message VOR (very high frequency omnirange) since this is mutually exclusive of the need for the message LOC (lateral guidance to runway) used in final landing of an airplane. The surface 85 may have a blank surface to illustrate when neither the LOC or VOR signals are required.

Similarly, the prism 38 may have the message TRK for track on surface 77 and a blank space on surface 79. The message TRK would indicate that either the localizer or VOR signal had not only been selected as indicated by the ARM message but that it also had been captured or the signal was "locked on" as opposed to the ARM message of merely being selected for capture and the signal upon which the circuit was locked has been verified as being the correct signal.

The push-pull solenoids 12 and 14 have been shown and will be operationally described as DC operated solenoids having a permanent magnet. However, they can also be implemented as soft iron solenoids having two separate windings with three electrical terminals on each unit to which signals are applied selectively.

OPERATION

While the operation of the present invention should be fairly obvious from the above Detailed Description, a review of operation will be provided. When an electrical signal is applied between terminals 20 and 22, the solenoid 14 is actuated and depending on the polarity of the signals applied, the rack 36 is either pushed or pulled. In the pushed mode, the VOR display is provided to the front of the display device so that it can be reviewed. In the pulled position, the LOC display is provided to the front and when no signal is applied, a blank is displayed to the front.

In similar fashion, a signal applied to leads 16 and 18 actuate solenoid 12 to either push or pull and to display either TRK or ARM. Thus, each half of a package of the same total size as a former annunciator detailed in the referenced patent, can now combine to supply twice as many individual messages on each display package. In addition, however, the two message displays can interact to provide two additional messages. In other words, with two blanks displayed to the front, the message is that there is no action whatsoever. If the LOC message is displayed and the solenoid 12 is actuated to the ARM position, the indication is that the localizer option has been selected. When the signal is removed from solenoid 12, the message LOC is the only one to appear thereby indicating that the localizer has not only selected but has captured a signal.

The action is similar for VOR, in that actuation of solenoid 14 will provide an indication of VOR and an actuation of solenoid 12 will place it in the ARM or selected mode. Like the localizer operation, a release of the signal to solenoid 12 indicates that it has captured a signal and is verifying to see whether or not it is the correct signal. Actuation of solenoid 12 in the opposite direction will provide an indication of TRK to the viewer indicating that the signal captured is verified as being the correct signal and that the device is operational.

The spring 44 is used to maintain contact between rack 36 and the appropriate gear such as 40 or 66 and thereby minimize backlash. The bearing surface 74, of course, provides a separation between the two prisms 38 and 64 and further provides a bearing surface upon which to rotate.

As will be realized, the prisms may have more than the two surfaces if the solenoids 12 and 14 can be accurately positioned to various linear motion states.

I thus wish to be limited not by the specific display illustrated but only by the inventive concept as outlined in the appending claims wherein we claim:

1. Annunciator apparatus comprising, in combination:

support means;

first and second push-pull drive means attached to said support means;

first and second multisurface prism means attached to said support means;

separate gear means connecting said first and second drive means respectively to said first and second multiprism means respectively; and separate biasing means attached to said support means and connected to each of said gear means for maintaining an interactive force between the teeth of said gear means to reduce backlash.

2. Annunciator apparatus comprising, in combination:

U-shaped support means including bit and leg portions;

first and second push-pull drive means attached to said bit portion of said support means;

first and second multisurface prism means pivotally connected to an axial member mounted between said leg portions of said support means; and separate gear means connecting said first and second drive means respectively to said first and second multisurface prism means respectively.

3. An annunciator package comprising:

a mounting frame member, a pair of prisms mounted for rotation about an axial member passing through an axis thereof with respect to said mounting frame member and each of said pair of prisms being formed with a plurality of information-bearing surfaces, a pair of rack-and-pinion means each interposed between said mounting frame member and a respective one of said prisms and actuable to rotate a respective one of said prisms, and a pair of push-pull solenoids carried on said mounting frame member each having an armature coupled to a respective one of said rack-and-pinion means and selectably actuable to cause rotation of one of said prisms in either direction.

4. An annunciator package comprising:

a generally U-shaped frame member having a pair of forwardly-extending leg portions joined by a cross-member;

a pair of prisms mounted for rotation about an axis between said leg portions and where each of said prisms is formed with a plurality of information-bearing surfaces;

a pair of rack-and-pinion means each interposed between a respective one of said leg portions and an adjacent end of a respective one of said prisms and actuable to rotate a respective one of said prisms; and a pair of push-pull solenoids carried by said cross-member each having an armature coupled to a respective one of said rack-and-pinion means and selectably actuable to cause rotation of one of said prisms in either direction.

5. Apparatus as claimed in claim 4 comprising, in addition:

spring biasing means, carried by each of said rack means and said frame member, for maintaining contact between said rack means and said prism means to minimize backlash.

6. Apparatus as claimed in claim 4 wherein the mounting mechanism for said pair of prisms comprises an axle including anti-rotation means for preventing accidental rotation of one of said pair of prisms upon movement of the other of said pair of prisms.

* * * * *